United States Patent [19]

Ruark et al.

[11] Patent Number: 4,915,089

[45] Date of Patent: Apr. 10, 1990

[54] TOOL FOR TRUEING AND DRESSING A GRINDING WHEEL AND METHOD OF USE

[75] Inventors: William W. Ruark, Westerville; Joseph A. Zahorchak, Columbus, both of Ohio; Glenn A. Johnson, Gotenba, Japan

[73] Assignee: General Electric Company, Worthington, Ohio

[21] Appl. No.: 296,291

[22] Filed: Jan. 10, 1989

Related U.S. Application Data

[63] Continuation of Ser. No. 149,274, Jan. 28, 1988, abandoned.

[51] Int. Cl.[4] ..... B24B 53/00

[52] U.S. Cl. ..... 125/11 CD; 51/51 D; 51/206 P

[58] Field of Search ..... 51/5 D, 206 R, 206 P, 51/206.4; 125/11 CD, 11 R, 15, 11 NT, 39

[56] References Cited

U.S. PATENT DOCUMENTS

| | | | |
|---|---|---|---|
| 2,380,451 | 7/1945 | Koebel | 125/11 R |
| 2,791,211 | 5/1957 | Nagy | 125/11 |
| 3,154,064 | 10/1964 | Koebel | 125/11 R |
| 3,370,385 | 2/1968 | Miller et al. | 51/5 D |
| 3,921,616 | 11/1975 | Kish | 125/11 CD |
| 4,020,820 | 5/1977 | Kish | 125/11 R |
| 4,073,281 | 2/1978 | Asaeda et al. | 125/11 CD |
| 4,235,218 | 11/1980 | Iida et al. | 125/11 CD |
| 4,266,374 | 5/1981 | Asano et al. | 51/155.87 |
| 4,285,324 | 8/1981 | Komanduri | 125/11 R |
| 4,286,568 | 9/1981 | Komanduri | 125/11 R |
| 4,300,522 | 11/1981 | Henry et al. | 125/11 R |
| 4,411,250 | 10/1983 | Lach | 125/11 CD |
| 4,452,223 | 6/1984 | Shank | 125/11 R |
| 4,535,571 | 8/1985 | Smith | 51/165.87 |
| 4,805,586 | 2/1989 | Borse | 51/204 |

FOREIGN PATENT DOCUMENTS 1475005 6/1977 United Kingdom .

*Primary Examiner*—Frederick R. Schmidt
*Assistant Examiner*—M. Rachuba
*Attorney, Agent, or Firm*—Gary L. Loser

[57] ABSTRACT

There is provided a tool for trueing and dressing a grinding wheel, comprising a wheel having a thin layer of diamonds in a plane perpendicular to the rotational axis of the tool. There is also provided a method for trueing and dressing a grinding wheel, comprising engaging the periphery of a rotating grinding wheel with a rotating trueing and dressing wheel having a thin layer of diamonds in a plane perpendicular to the rotational axis of the trueing and dressing wheel. Preferably, the trueing and dressing wheel is disposed between the headstock and tailstock of a grinding machine in place of the workpiece.

14 Claims, 3 Drawing Sheets

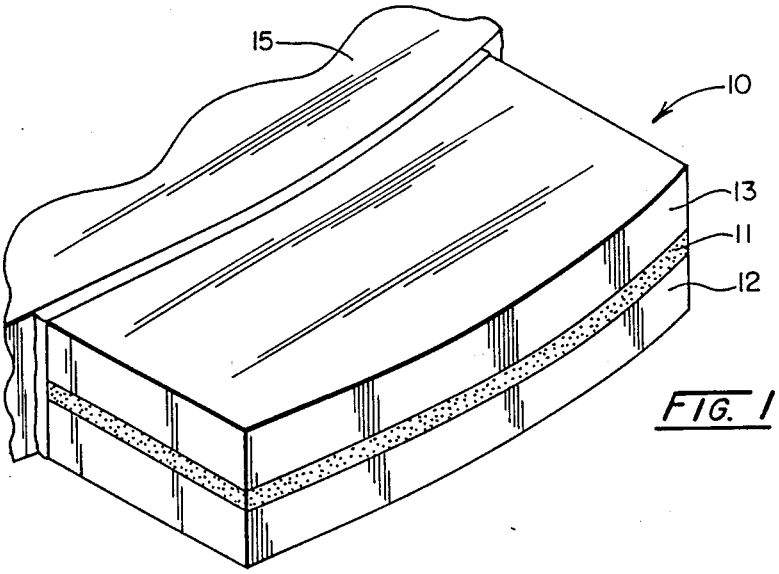
FIG. 1
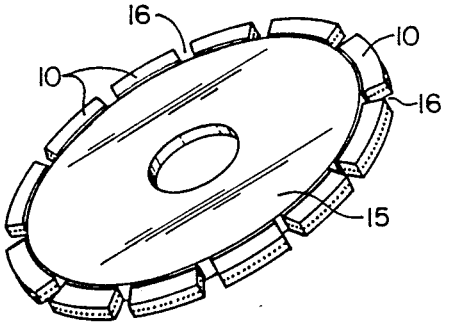
FIG. 2
FIG. 3
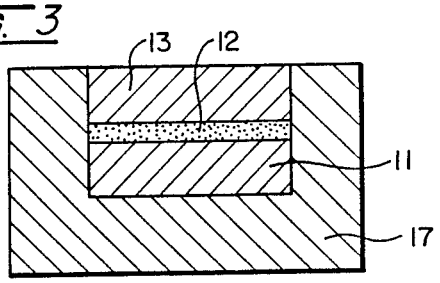

TOOL FOR TRUEING AND DRESSING A GRINDING WHEEL AND METHOD OF USE

This is a continuation-in-part, of application Ser. No. 07/149,274, filed 1/28/88 now abandoned.

BACKGROUND OF THE INVENTION

The present invention relates to a method for trueing and dressing grinding wheels and to a novel trueing and dressing tool. More particularly, the present invention relates to a method for trueing and dressing grinding wheels having vitrified-bonded cubic boron nitride (CBN) abrasive by use of a fine point trueing disc mounted between the existing headstock and tailstock of a grinding machine.

A number of grinding wheels are known to those skilled in the art including, for example, conventional aluminum oxide and silicon carbide grinding wheels as well as resin-bonded and vitrified-bonded CBN grinding wheels and diamond grinding wheels. Regardless of the type of grinding wheel, it is necessary to true and dress the grinding wheel in order that it may accurately form fine finishes or precise contours on workpieces.

A variety of methods for trueing and dressing grinding wheels are known in the art, however each has various drawbacks and disadvantages, particularly with regard to trueing and dressing grinding wheels whose abrasive material is vitreous-bonded CBN. One prior art method is disclosed in U.S. Pat. No. 2,791,211 to Nagy and involves periodically indexing a diamond tipped dressing tool in relation to the grinding wheel so that in all indexing positions the diamond is in contact with the wheel in a direction of hard grain forming an angle of between 30° and 45° to a crystal axis of the diamond. While such a single point tool is useful for dressing small diameter grinding wheels, the diamond tip would wear much too rapidly to be useful in dressing large diameter grinding wheels, especially vitrified-bonded CBN grinding wheels.

Alternatives to single point trueing and dressing tools include hand set diamond and metal-bonded diamond rotary cup and straight wheel tools. While such rotary dressing tools are more effective than single point tools, they have the disadvantage of being relatively expensive, and, furthermore, they are used in conjunction with a relatively expensive electric or hydraulic precision drive motor and spindle assembly. Consequently, small machine shops are unable to avail themselves of rotary dressing technology. Another disadvantage of rotary cup wheel dressing tools is the necessity of changing the position or angle of the dressing wheel in order to present new, sharper edges as the originally presented edges wear flat. Straight wheel dressing tools suffer from the further disadvantage of having the abrasive applied to the circumferential surface of the wheel in a band several millimeters in width. As a result, the operator has very little control over the dressed surface of the vitrified-bonded CBN grinding wheels because a wide band of abrasive, unlike a sharp point, generally leaves the wheel in a closed or dull condition. Wheels in this condition generate excessive heat, which may cause the wheel to burn the workpiece.

While such prior art methods are generally considered to be acceptable, manufacturers are always concerned with improving the trueing and dressing process, such as by reducing the time required to true and dress a grinding wheel and reducing the cost of the trueing and dressing tool.

SUMMARY OF THE INVENTION

It is an object of the present invention to provide a fine point trueing and dressing wheel.

It is another object of the present invention to provide a method for making a fine point trueing and dressing wheel.

It is still another object of the present invention to provide a method for trueing and dressing a grinding wheel with a trueing and dressing wheel that can be mounted between the headstock and the tailstock of a grinding machine in place of the workpiece.

In accordance with one aspect of the present invention, there is provided a tool for trueing and dressing a grinding wheel, comprising a disc having a thin layer of diamonds in a plane perpendicular to the rotational axis of said disc. Preferably, the thin layer of diamonds is only a single layer of diamonds in width and is disposed inside the trueing and dressing wheel. In a less preferred embodiment, a single layer of diamonds is plated or metal-bonded to at least one side of the trueing and dressing wheel.

In accordance with another aspect of the present invention, there is provided a method for trueing and dressing a grinding wheel, comprising engaging the periphery of the rotating grinding wheel with a rotating trueing and dressing wheel disposed intermediate the headstock and tailstock of a grinding machine.

BRIEF DESCRIPTION OF THE DRAWINGS

FIG. 1 is a front elevation view of a portion of one embodiment of the trueing and dressing wheel; and FIG. 2 is a front elevation view of one embodiment of the trueing and dressing tool;

FIG. 3 is a front sectional view of the method of manufacture of the portion of the trueing and dressing wheel shown in FIG. 2;

DESCRIPTION OF THE INVENTION

Figure 4:
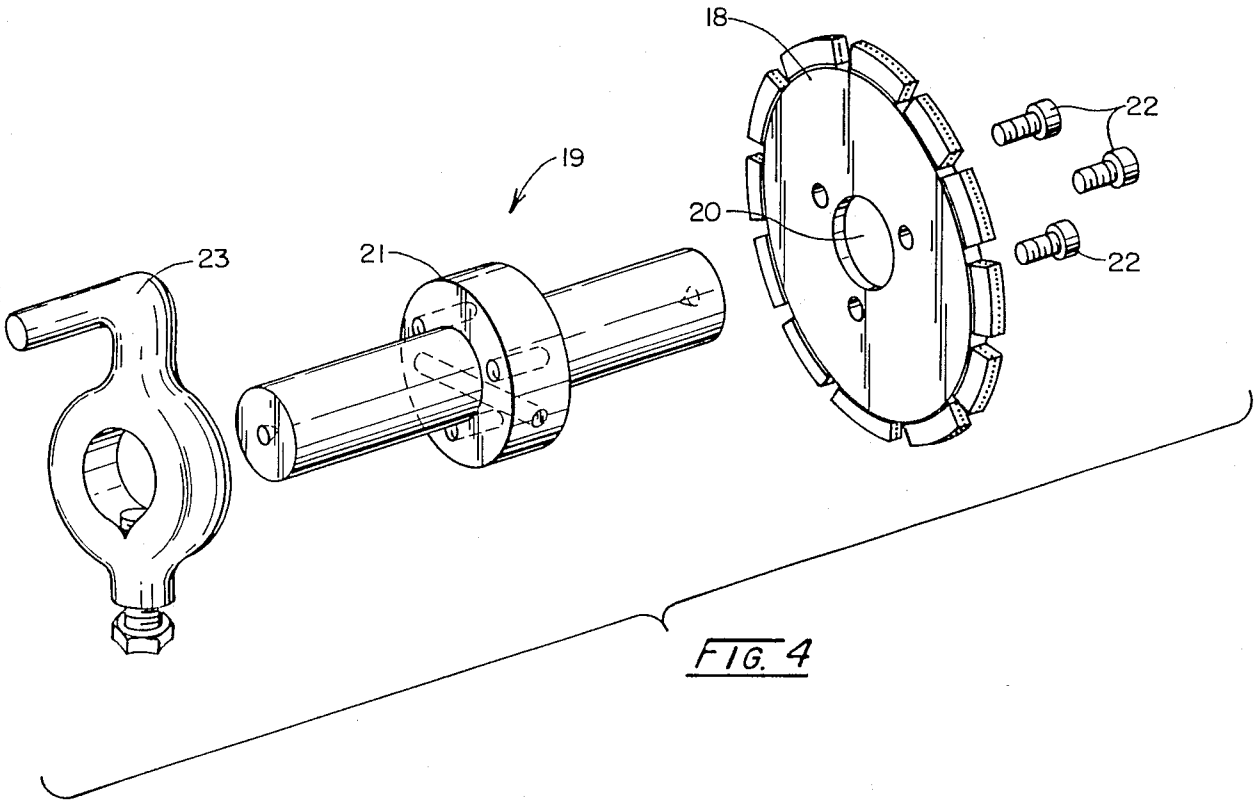
FIG. 4 is an exploded front view of the trueing and dressing wheel and its mounting assembly.

There is provided by the present invention a tool for trueing and dressing a grinding wheel, comprising a disc having a thin layer of diamonds in a plane perpendicular to the rotational axis of said disc. Although the trueing and dressing tool of the present invention is especially suited for trueing and dressing large diameter vitrified-bonded CBN grinding wheels, it may also be used effectively and efficiently on conventional grinding wheels such as, for example, aluminum oxide and silicon carbide, as well as resin-bonded CBN grinding wheels and diamond grinding wheels.

Referring now to the drawing, FIG. 1 shows a segment 10 of a preferred embodiment of the present invention. Segment 10 preferably comprises a thin layer of diamonds 11 disposed intermediate a first metal section 12 and a second metal section 13. Inasmuch as diamond layer 11 functions to true and dress the grinding wheel, the more narrow the diamond layer 11, the more closely the trueing and dressing tool of the present invention will operate as a single point trueing device. Although it is most preferred that diamond layer 11 only be a single diamond in width, in some instances it might be more practical to prepare tools wherein diamond layer 11 is several diamonds in width, for example, up to about 0.8 millimeters in width, so as to provide a fine point trueing and dressing tool.

Diamond particles of any size may be employed in diamond layer 11, depending upon the trueing and dressing requirements. Preferably, larger size diamond particles, e.g., 20/25 to 30/40 U.S. mesh size, are utilized for trueing and dressing vitrified-bonded CBN grinding wheels as they provide a longer useful life. The artisan will be able to select suitable diamond particle sizes for use in trueing and dressing other types of grinding wheels without undue experimentation.

In an alternative, but less preferred embodiment (not shown), it is contemplated that diamond layer 11 can be attached to one or both sides of the trueing tool, for example, by plating or metal bonding. This embodiment, although simple to manufacture, suffers from the disadvantage that the diamond particles of the tool are not held in place as firmly as in the preferred embodiment.

Sections 12 and 13 may consist of any suitable metal bonding matrix with harder bonds such as those containing iron or cobalt being most preferred. The most important criteria in selecting the material for sections 12 and 13 is that it be sufficiently hard to retain the diamonds of section 11 in the trueing and dressing tool of the present invention and will not deform or vibrate during use.

FIG. 2 illustrates one preferred embodiment wherein a plurality of sections 10 shown in FIG. 1 are attached to disc 15, for example, by use of a suitable brazing material. Disc 15 can be any suitable, relatively stiff material and preferably is a metal or metal alloy. Typically, the core or disc 15 will be between $\frac{1}{8}$ and $\frac{3}{8}$ inch in thickness. Brazing material can be any of the well known brazes, for example, as described in U.S. Pat. Nos. 4,396,577 and 4,414,178 to Smith, et al., both of which are assigned to the same assignee as the present invention and incorporated by reference into the present disclosure. Of course, other suitable brazing materials will be obvious to those skilled in the art.

There is no particular criticality regarding the length of sections 10 or the spacing 16 between sections 10 shown in the "sawblade" configuration of FIG. 2. The limiting consideration is obtaining an effective and efficient trueing and dressing tool while not utilizing an excessive amount of diamonds. In a second preferred embodiment, not shown, the diamond abrasive continues around the entire circumferences of the trueing and dressing wheel of the present invention.

Figure 5:
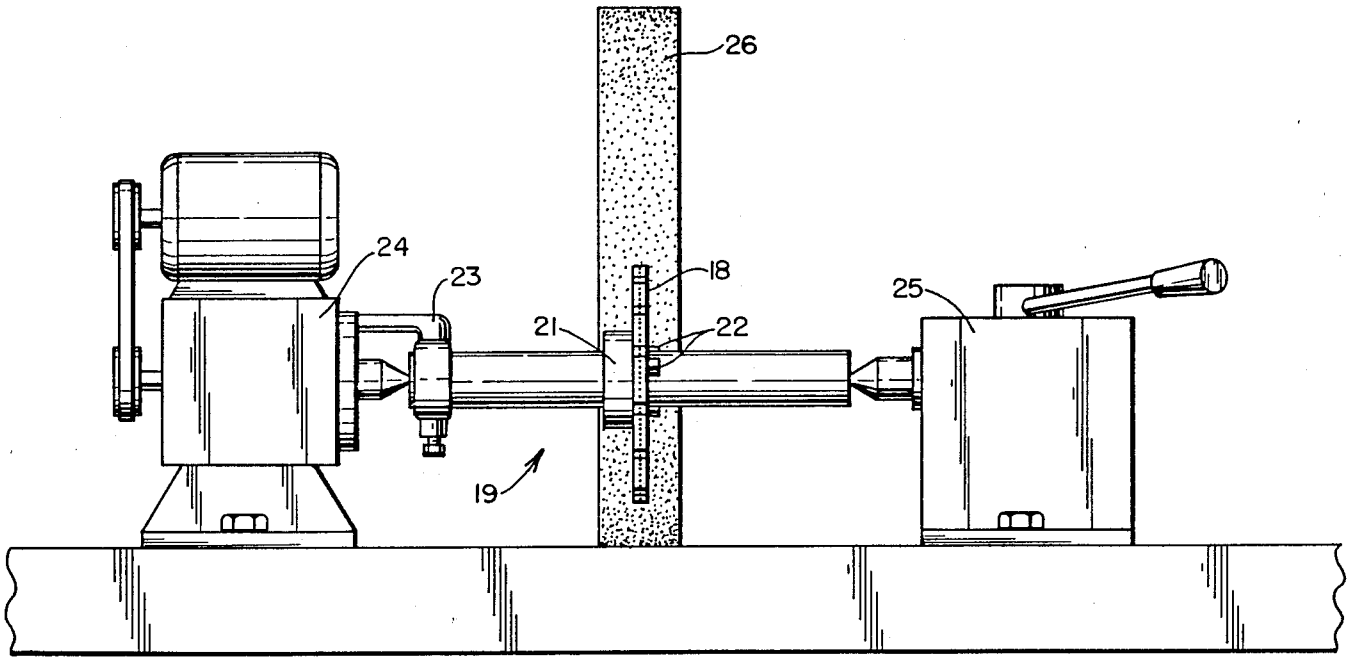
FIG. 5 is a front elevation view of the trueing and dressing wheel mounted on a grinding machine.

In general, there are no limitations regarding the diameter of the trueing and dressing wheel other than it must be able to be mounted between the powered headstock and tailstock of a grinding machine as illustrated in FIG. 5. The optimum diameter of the truing and dressing wheel is most affected by the grinding machine on which it is to be used, the available speed of the headstock, and the diameter of the grinding wheel. Typically, the trueing and dressing wheel of the present invention will range between four inches for use on small grinding wheels and ten inches or more for use on large grinding wheels.

FIG. 3 illustrates a preferred method for making the fine point trueing and dressing wheels of the invention. Initially, first section 12 is cold pressed by means well known in the art in mold 17. If a sawblade type trueing and dressing tool is to be manufactured, thin diamond layer 11 is applied across the entire upper surface of section 12 as shown in FIG. 3. On the other hand, if the diamond abrasive is to continue around the entire circumference of the truing and dressing tool, mold 17 would be the size of the trueing and dresisng wheel, however, diamond layer 11 would only extend partially towards the center of the wheel in order to minimize the cost of the tool. Of course, there would be an opening at the center of the mold which would correspond to the size of the wheel core as shown in FIG. 2. Following addition of the appropriate amount of diamond 11, an amount of metal bond powder is added which is sufficient to form second section 13 upon hot pressing. If the unitary or second embodiment is being manufactured, hot pressing is all that is needed to make the finished trueing and dressing tool. If, however, only a segment 10 as shown in FIG. 1 is prepared by the hot pressing step, it is necessary to braze segment 10 to disc 15 as the final step.

FIG. 4 illustrates one means for securing the trueing and dressing tool 18 of the present invention to a spindle and flange assembly 19 which can be mounted beween the headstock and tailstock of a grinding machine. Briefly, tool 18 is mounted through its central opening 20 onto spindle and flange assembly 19 and held in close contact with flange 21 by means of threaded screws 22. The combined tool 18 and spindle and flange assembly 19 is then inseted into driving dog 23 in the same way as would a workpiece. Alternatively, combined tool 18 and spindle and flange assembly 19 can be affixed to a headchuck, not shown.

In either case, the completed mounting assembly is secured between the existing headstock 24 and tailstock 25 of the grinding machine as shown in FIG. 5 when mounted between centers. It would, of course, be highly desirable to have a variety of spindle lengths available which are approximately equal to the length of commonly encountered workpieces. In this way, the operator can more easily substitute the trueing and dressing wheel for the workpiece.

Trueing and dressing is effected by engaging the periphery of the grinding wheel with the rotating trueing and dressing wheel. Rotational power for the trueing and dressing wheel is supplied by the workhead of the grinding machine and is transmitted to the trueing and dressing wheel via driving dog 23 or the workpiece chuck assembly, not shown. Although greater convenience is obtained when rotational power is provided to the trueing and dressing tool in this manner, the tool is equally effective when driven by a precision spindle and drive motor. Trueing and dressing is accomplished by traversing the trueing wheel 18 across the grinding wheel 26 using the grinding machine's powered table and feed controls. The surface condition generated on grinding wheel 26 can be controlled by increasing the trueing or dressing rate for a finer finish, i.e., increasing or decreasing the machine table and/or infeed rate.

We claim:

1. A tool for trueing and dressing a grinding wheel, comprising a wheel having a thin layer of mesh size diamonds in a plane perpendicular to the rotational axis of said wheel.

2. A tool as in claim 1, wherein the layer of diamonds is up to about 0.8 millimeters in width.

3. A tool as in claim 1, wherein the layer of diamonds is a single diamond in width.

4. A tool as in claim 1, wherein the size of the diamond particles in the layer of diamonds is from about 20/25 to about 30/40 mesh.

5. A tool as in claim 1, wherein the layer of diamonds is attached to at least one side of said tool.

6. A tool as in claim 5, wherein said layer of diamonds is attached to said tool by plating or metal bonding.

7. A tool as in claim 1, wherein the layer of diamonds is disposed intermediate the sides of said tool.

8. A tool as in claim 1, wherein said tool is from about $\frac{1}{8}$ to about $\frac{3}{8}$ inch in thickness.

9. A tool as in claim 1, wherein said wheel comprises a disc having segments containing a thin layer of diamonds affixed to said disc.

10. A tool as in claim 1, wherein said wheel is of unitary construction.

11. A method for trueing and dressing a grinding wheel, comprising engaging the periphery of a rotating grinding wheel with a rotating trueing and dressing tool having a thin layer of diamonds in a plane perpendicular to the rotational axis of said tool.

12. A method as in claim 11, wherein said trueing and dressing tool is disposed intermediate a headstock and a tailstock of a grinding machine.

13. A method as in claim 12, wherein rotational power is transmitted to said trueing and dressing tool via a driving dog.

14. A method as in claim 12, wherein rotational power is transmitted to said trueing and dressing tool via a head chuck.

* * * * *